US007831182B2

(12) United States Patent
Konishi et al.

(10) Patent No.: US 7,831,182 B2
(45) Date of Patent: Nov. 9, 2010

(54) DEVELOPING DEVICE, IMAGE FORMING APPARATUS, AND DEVELOPMENT ERROR DETECTING METHOD

(75) Inventors: Rumi Konishi, Osaka (JP); Kenji Asuwa, Tokyo (JP); Yoshiko Ogawa, Osaka (JP); Shuuichi Nakagawa, Osaka (JP); Ryuji Inoue, Hyogo (JP); Shin Murayama, Hyogo (JP); Kazushige Oonishi, Tokyo (JP); Shintaro Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 256 days.

(21) Appl. No.: 12/099,525

(22) Filed: Apr. 8, 2008

(65) Prior Publication Data

US 2008/0267641 A1 Oct. 30, 2008

(30) Foreign Application Priority Data

Apr. 26, 2007 (JP) ..... 2007-116549

(51) Int. Cl.
*G03G 15/08* (2006.01)

(52) U.S. Cl. ..... 399/281; 399/53

(58) Field of Classification Search ..... 399/27, 399/29, 53, 257, 272, 279, 281
See application file for complete search history.

(56) References Cited

U.S. PATENT DOCUMENTS

| | | | | |
|---|---|---|---|---|
| 5,324,884 | A * | 6/1994 | Honda et al. | 399/279 |
| 7,103,294 | B2 * | 9/2006 | Kawano | 399/281 X |
| 2003/0219285 | A1 * | 11/2003 | Nakagawa | 399/281 |
| 2006/0280529 | A1 | 12/2006 | Nakagawa et al. | |
| 2007/0077076 | A1 * | 4/2007 | Yoshida | 399/27 |
| 2007/0104523 | A1 | 5/2007 | Yoshida et al. | |
| 2007/0189812 | A1 | 8/2007 | Murayama et al. | |

FOREIGN PATENT DOCUMENTS

| | | | |
|---|---|---|---|
| JP | 7-13427 | | 1/1995 |
| JP | 07-013427 | * | 1/1995 |
| JP | 11-84850 | | 3/1999 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A disclosed developing device includes a developing roller; a supply roller that is in contact with the developing roller and configured to supply toner to the developing roller; a current measuring unit configured to measure an electric current that flows from the developing roller to the supply roller when the toner is supplied from the supply roller to the developing roller; and an error determining unit configured to detect a development error of the developing roller based on the electric current measured by the current measuring unit.

18 Claims, 5 Drawing Sheets

DEVELOPING DEVICE, IMAGE FORMING APPARATUS, AND DEVELOPMENT ERROR DETECTING METHOD

BACKGROUND OF THE INVENTION

1. Field of the Invention

The present invention generally relates to a developing device used in an image forming apparatus, such as a copier, a fax machine, a printer, or a multifunction copier; an image forming apparatus including the developing device; and a method of detecting a development error in the developing device.

2. Description of the Related Art

One problem with an image forming apparatus using a conventional one-component-toner developing device is that a film of toner tends to be formed (called toner filming) on a developing roller over time. The toner filming makes it difficult to stably charge toner and causes problems such as scumming (smear on a non-image area) and low image density. Specifically, when toner filming occurs or a developing roller is covered by a film of toner, it becomes difficult to stably charge toner by the surface of the developing roller. This problem also occurs in an image forming apparatus using a two-component-toner developing device.

Another problem with a conventional one-component-toner developing device is that an additive added to toner to improve its fluidity tends to be buried in or separated from the toner while the toner is carried or agitated by an agitating part in the developing device. This in turn degrades the charging characteristics of the toner itself.

Degradation in charging characteristics or fluidity of toner caused by degradation of toner itself or toner filming on a developing roller in turn inhibits smooth supply of toner to a developer tank or inhibits smooth supply of toner from a supply roller to a developing roller even if a sufficient amount of toner is in the developer tank, and thereby causes density irregularity or voids (portions unintentionally left blank) in an image.

Meanwhile, there are various types of developer-amount detecting devices that detect the amount of remaining toner using different methods: an optical method, a sound and vibration method, a current measurement method, a capacitance detection method, a float method, a drive load detection method, etc. (see, for example, patent document 1). In a developing device disclosed in patent document , a change in load resistance, which varies depending on the amount of remaining developer, of a developer carrier is detected by measuring a change in the interval between wave pulses output from an encoder in synchronization with the rotation of the developer carrier, and the amount of developer in a developer container is detected based on the change in load resistance. Although this technology makes it possible to detect the amount of remaining toner in a developer container, it is not possible to determine whether a proper amount of toner is being supplied to a developing roller.

Patent document 2 discloses a method of detecting the amount of toner on a developing roller. In the disclosed method, the amount of friction-charged toner adhering to a developing roller is detected based on the amount of electric current flowing through a shaft of the developing roller, and the detected amount of toner is compared with a predetermined reference value to determine whether a sufficient amount of toner is in a developer container. However, because a developing roller is in contact with many other parts such as a toner regulating part for charging toner and forming a toner layer on the developing roller, a discharging part for removing toner from the developing roller, and a photoconductor, the electric current flowing through the developing roller shaft is complicated and the amount of electric current varies depending on the degree of degradation of those parts.

[Patent document 1] Japanese Patent Application Publication No. 11-84850

[Patent document 2] Japanese Patent Application Publication No. 7-13427

SUMMARY OF THE INVENTION

Embodiments of the present invention provide a developing device, an image forming apparatus including the developing device, and a method of detecting a development error in the developing device that solve or reduce one or more problems caused by the limitations and disadvantages of the related art.

An embodiment of the present invention provides a developing device that includes a developing roller; a supply roller that is in contact with the developing roller and configured to supply toner to the developing roller; a current measuring unit configured to measure an electric current that flows from the developing roller to the supply roller when the toner is supplied from the supply roller to the developing roller; and an error determining unit configured to detect a development error of the developing roller based on the electric current measured by the current measuring unit.

Another embodiment of the present invention provides an image forming apparatus including a developing device. The developing device includes a developing roller; a supply roller that is in contact with the developing roller and configured to supply toner to the developing roller; a current measuring unit configured to measure an electric current that flows from the developing roller to the supply roller when the toner is supplied from the supply roller to the developing roller; and an error determining unit configured to detect a development error of the developing roller based on the electric current measured by the current measuring unit.

Still another embodiment of the present invention provides a method of detecting a development error in a developing device including a developing roller and a supply roller in contact with the developing roller. The method includes the steps of measuring an electric current that flows from the developing roller to the supply roller when toner is supplied from the supply roller to the developing roller; and detecting the development error based on the measured electric current.

DESCRIPTION OF THE PREFERRED EMBODIMENTS

Preferred embodiments of the present invention are described below with reference to the accompanying drawings.

First Embodiment

Figure 1:
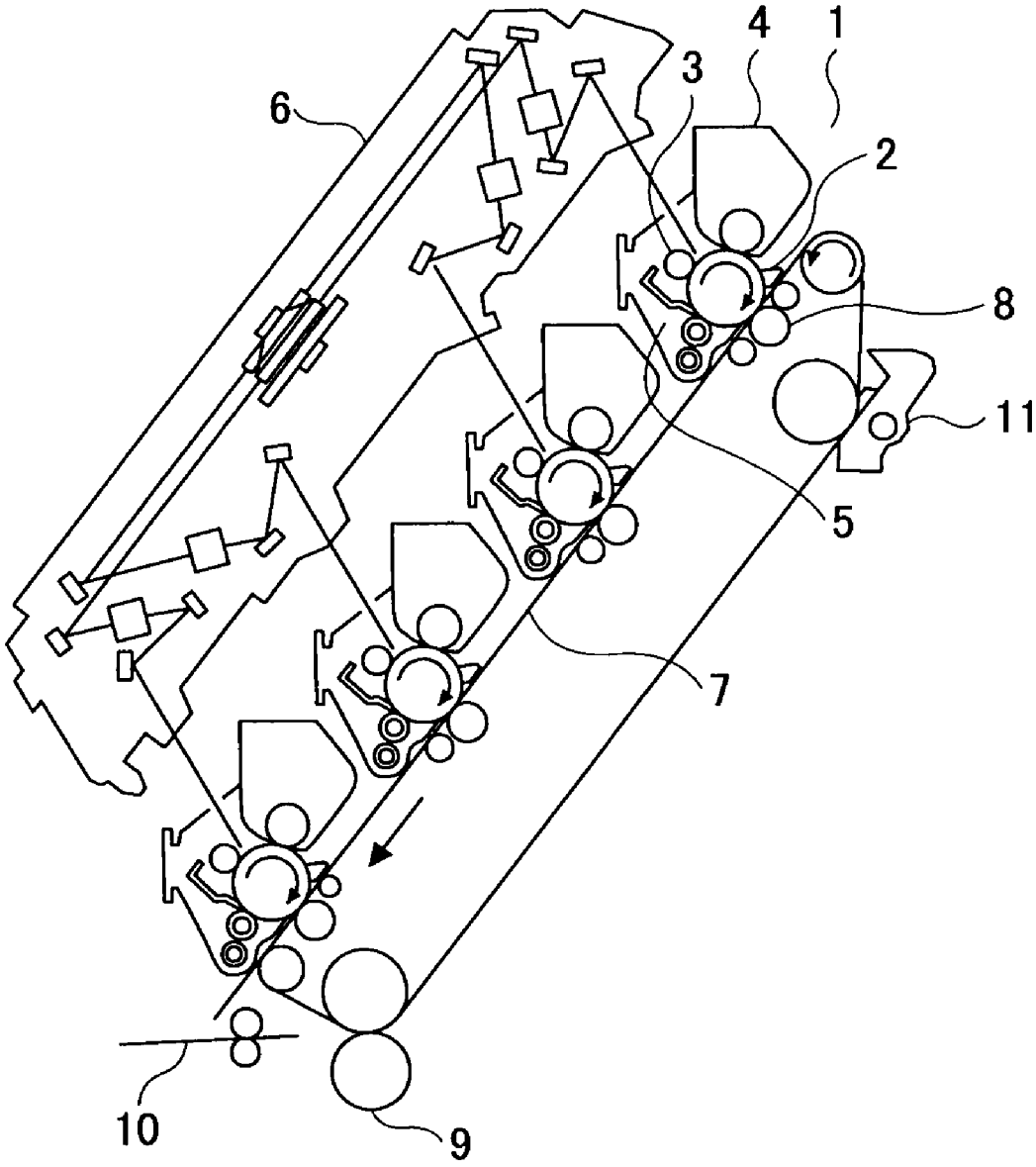
FIG. 1 is a cut-away side view of a part of an image forming apparatus including developing units according to an embodiment of the present invention.

FIG. 1 is a cut-away side view of a part of an image forming apparatus including developing units according to an embodiment of the present invention. The exemplary image forming apparatus includes four process cartridge units 1. Each process cartridge unit 1 includes a photoconductive drum 2, a charging roller 3, a developing unit (developing device) 4, and a cleaning unit 5. The process cartridge unit 1 can be replaced by releasing a stopper. Although the developing unit 4 is incorporated in the process cartridge unit 1 in this embodiment, the developing unit 4 may be provided as a separate component of the image forming apparatus.

The photoconductive drum 2 rotates at a circumferential speed of 150 mm/s in a direction indicated by an arrow in FIG. 1. The charging roller 3 is pressed against the surface of the photoconductive drum 2 and rotates as the photoconductive drum 2 rotates. A bias voltage is applied from a high-voltage power supply (not shown) to the charging roller 3, and the charging roller 3 charges the surface of the photoconductive drum 2 to −500 V. The exemplary image forming apparatus also includes an exposing unit 6 that exposes the photoconductive drum 2 according to image data and thereby forms an electrostatic latent image. For example, the exposing unit 6 employs LEDs or laser beam scanners using laser diodes. The developing unit 4 is a one-component contact developing device, and develops an electrostatic latent image on the photoconductive drum 2 to form a toner image. A developing bias is applied from a high-voltage power supply (not shown) to the developing unit 4. The cleaning unit 5 removes toner remaining on the photoconductive drum 2 after image transfer.

The process cartridge units 1 are arranged in the moving direction of an intermediate transfer belt 7 and form toner images of yellow, cyan, magenta, and black, respectively, in the order mentioned.

A primary transfer roller 8 causes a toner image on the photoconductive drum 2 to be transferred onto the intermediate transfer belt 7. A primary transfer bias is applied to the primary transfer roller 8. The intermediate transfer belt 7 is rotated by a drive motor (not shown) in a direction indicated by an arrow in FIG. 1. Toner images of different colors are superposed on the intermediate transfer belt 7 and thereby form a full color image.

The formed full color image is transferred onto a paper sheet 10 (or a recording medium) by a secondary transfer roller 9 to which a predetermined voltage is applied. Then, the full color image on the paper sheet 10 is fused by a fusing unit (not shown). After the full color image is transferred by the secondary transfer roller 9, toner remaining on the intermediate transfer belt 7 is reclaimed by a transfer belt cleaning unit 11.

Figure 2:
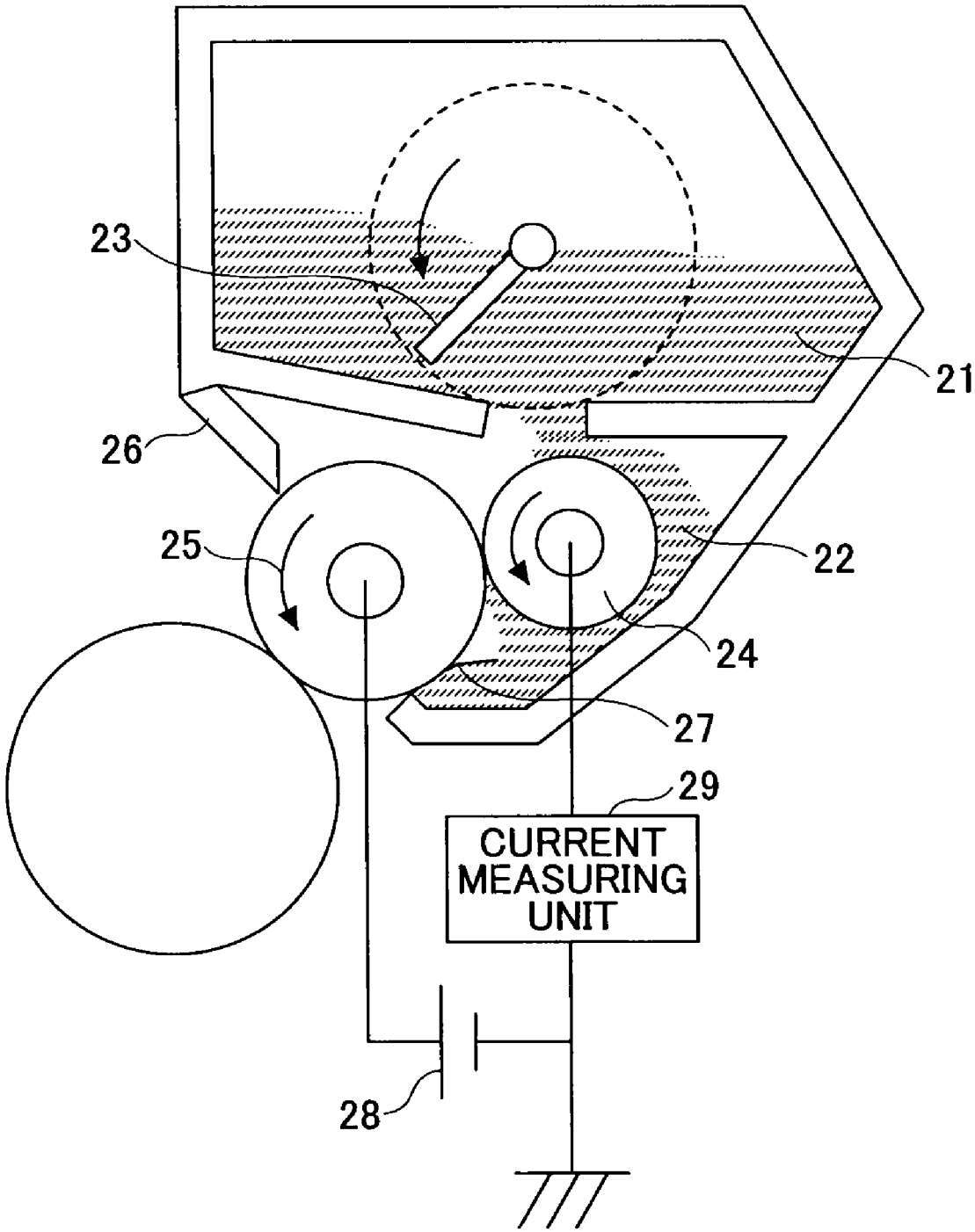
FIG. 2 is a cut-away side view of a developing unit according to a first embodiment of the present invention.

FIG. 2 is a cut-away side view of the developing unit 4 according to a first embodiment of the present invention. The developing unit 4 may or may not be incorporated in a process cartridge. The developing unit 4 comprises a toner unit including a toner container 21 and a developer tank 22. An agitator 23 provided in the toner container 21 feeds toner to the developer tank 22. As the toner, for example, a nonmagnetic negatively-charged toner with a resistivity of $10^{10}$ Ωcm may be used. The toner fed into the developer tank 22 is supplied via a supply roller 24 to a developing roller 25 facing and being in contact with the supply roller 24. A toner regulating blade 26 smoothes the toner and forms a thin layer of toner on the developing roller 25. A part of the thin layer of toner on the developing roller 25 is used to develop a latent image on the photoconductive drum 2 facing the developing roller 25. Toner remaining on the developing roller 25 after the development is discharged by a discharging sheet 27 and returns into the developer tank 22.

A voltage is applied from a power supply 28 between the metal shafts of the developing roller 25 and the supply roller 24. The surface layers of the developing roller 25 and the supply roller 24 are made of conductive materials. An electric current that flows from the supply roller 24 to its metal shaft is measured by a current measuring unit 29 connected between the power supply 28 and the metal shaft of the supply roller 24.

Figure 3:
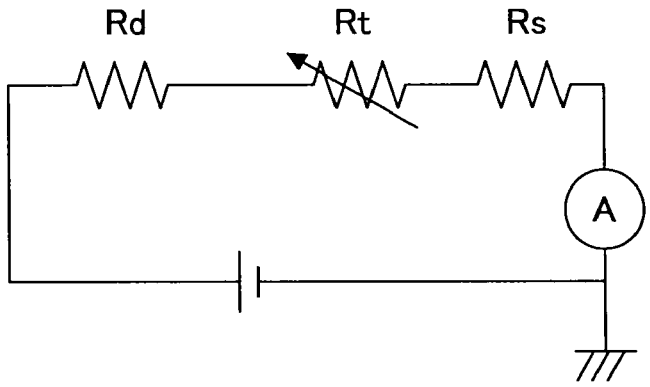
FIG. 3 is an equivalent circuit schematic illustrating a current flow from a developing roller, via a supply roller, to a current measuring unit.

FIG. 3 is an equivalent circuit schematic illustrating a current flow from the developing roller 25, via the supply roller 24, to the current measuring unit 29. In FIG. 3, Rd, Rt, and Rs indicate resistances of the developing roller 25, toner, and the supply roller 24, respectively. Because of the voltage applied between the developing roller 23 and the supply roller 24, an electric field is formed between the developing roller 25 and the supply roller 24. The electric field causes charged toner to be transferred from the supply roller 24 onto the developing roller 25. To efficiently transfer toner, it is necessary to make the voltage of toner higher than that of the developing roller 25 and the supply roller 24. In other words, it is necessary to make the volume resistivity of the developing roller 25 and the supply roller 24 sufficiently smaller than the resistivity of toner. In this embodiment, the resistivity of toner base particles is $10^{10}$ Ωcm and the resistivity of the developing roller 25 and the supply roller 24 is $10^5$-$10^8$ Ωcm. More preferably, the resistivity of the developing roller 25 is $10^4$-$10^8$ Ωcm, and the resistivity of the supply roller 24 is $10^5$-$10^8$ Ωcm. With the resistivity values described above, the amount of electric current flowing from the metal shaft of the supply roller 24 into the current measuring unit 29 is influenced most by the resistance of toner.

Figure 4:
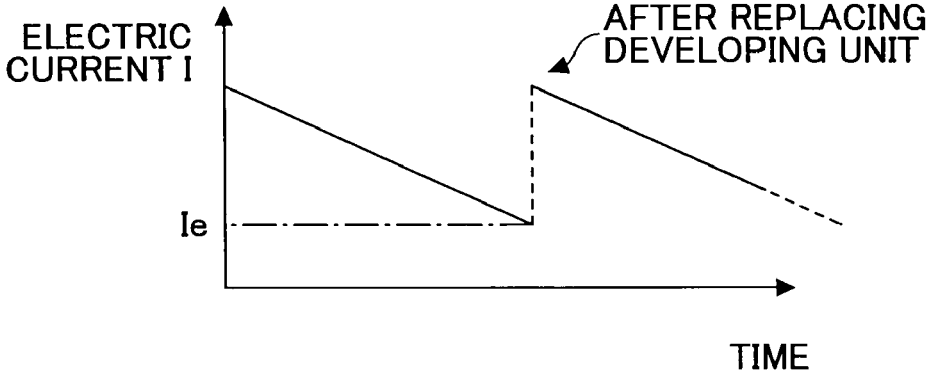
FIG. 4 is a graph showing an electric current measured by a current measuring unit which electric current decreases as the amount of toner transferred to a developing roller decreases.

When negatively-charged toner is transferred from the supply roller 24 to the developing roller 25, electrons are transferred from the supply roller 24 to the developing roller 25 and an electromotive force is generated. As a result, an electric current flows from the developing roller 25 to the supply roller 24 and the apparent resistivity of the toner decreases. When toner is not transferred to the developing roller 25, electrons are not transferred and the apparent resistivity of toner increases. As a result, the electric current measured by the current measuring unit 29 decreases. Therefore, as the amount of toner transferred from the supply roller 24 to the developing roller 25 decreases because of toner filming or degradation of the toner over time (i.e., because of degradation of the charging characteristics and fluidity of toner), the electric current measured by the current measuring unit 29 decreases as shown in FIG. 4. In this embodiment, an electric current value corresponding to the minimum amount of toner (transferred from the supply roller 24 to the developing roller 25) necessary to maintain a satisfactory image quality is retained in a memory (not shown) as a threshold for detecting a development error. When the electric current measured by the current measuring unit 29 becomes smaller than the threshold, the developing unit 4 (or an error determining unit described later) determines that a development error has occurred.

Alternatively, the developing unit 4 may be configured to determine that a development error has occurred if a change in the electric current measured by the current measuring unit 29 exceeds a predetermined value (or a threshold) retained in a memory. When printing is being performed normally, the electric current flowing from the developing roller 25 to the supply roller 24 changes gradually. If the electric current changes rapidly, it may indicate that the developer tank 22 is out of toner, or the amount of toner being transferred from the supply roller 24 to the developing roller 25 is small. Further, the developing unit 4 may be configured to determine that a development error has occurred if the rate of change in an electric current exceeds a predetermined threshold. This configuration or method makes it possible to accurately determine the occurrence of a development error without being affected by an intrinsic difference in the absolute value of the electric current which depends on the environment where a developing device is used or on the characteristics of a developing device.

Second Embodiment

Figure 5:
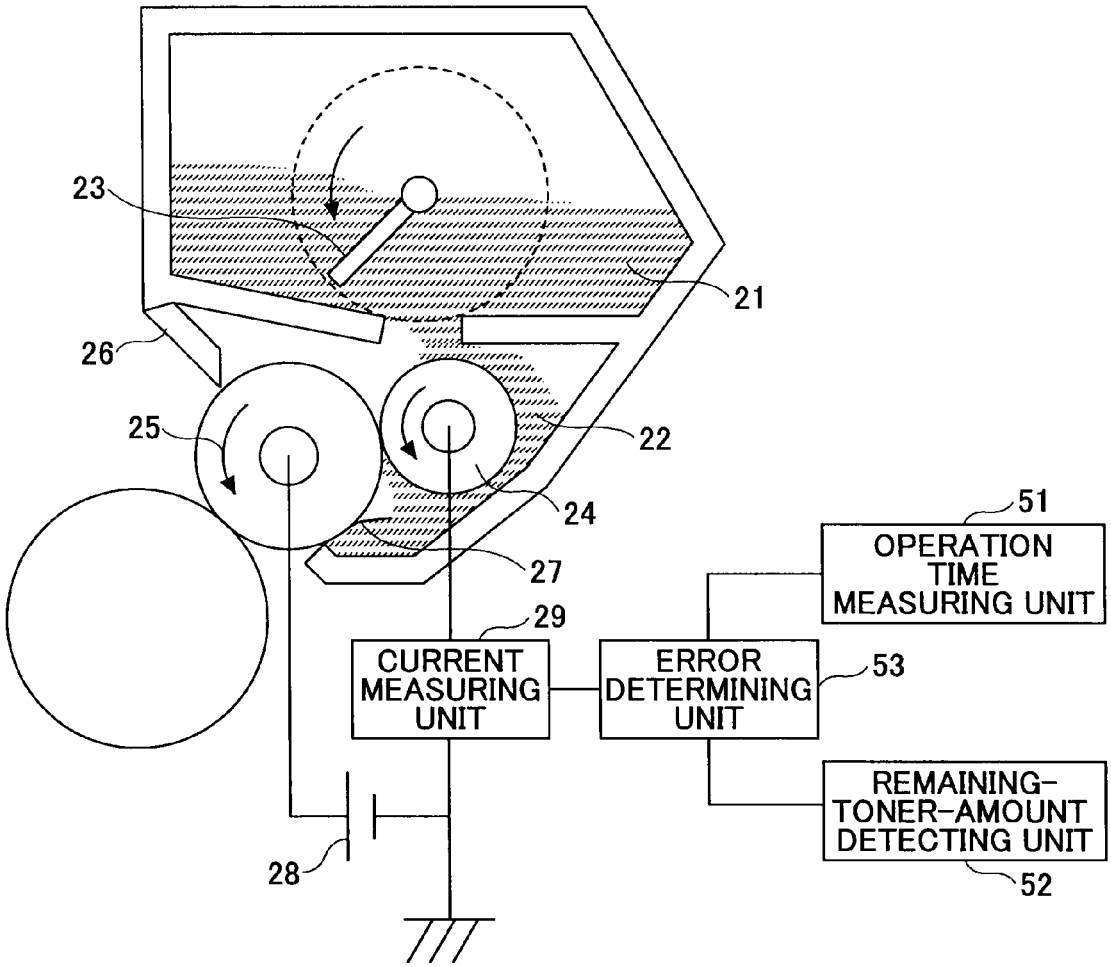
FIG. 5 is a cut-away side view of a developing unit according to a second embodiment of the present invention.

FIG. 5 is a cut-away side view of the developing unit 4 according to a second embodiment of the present invention. The developing unit 4 may or may not be incorporated in a process cartridge. The developing unit 4 of the second embodiment includes, in addition to the current measuring unit 29, an operation time measuring unit 51 for measuring the operation time (the total amount of time the developing unit 4 has been in operation) of the developing unit 4, a remaining-toner-amount detecting unit 52 for detecting the amount of toner remaining in the toner container 21 (or the toner unit), and an error determining unit 53 for determining an error based on outputs from the current measuring unit 29, the operation time measuring unit 51, and the remaining-toner-amount detecting unit 52.

Figure 6:
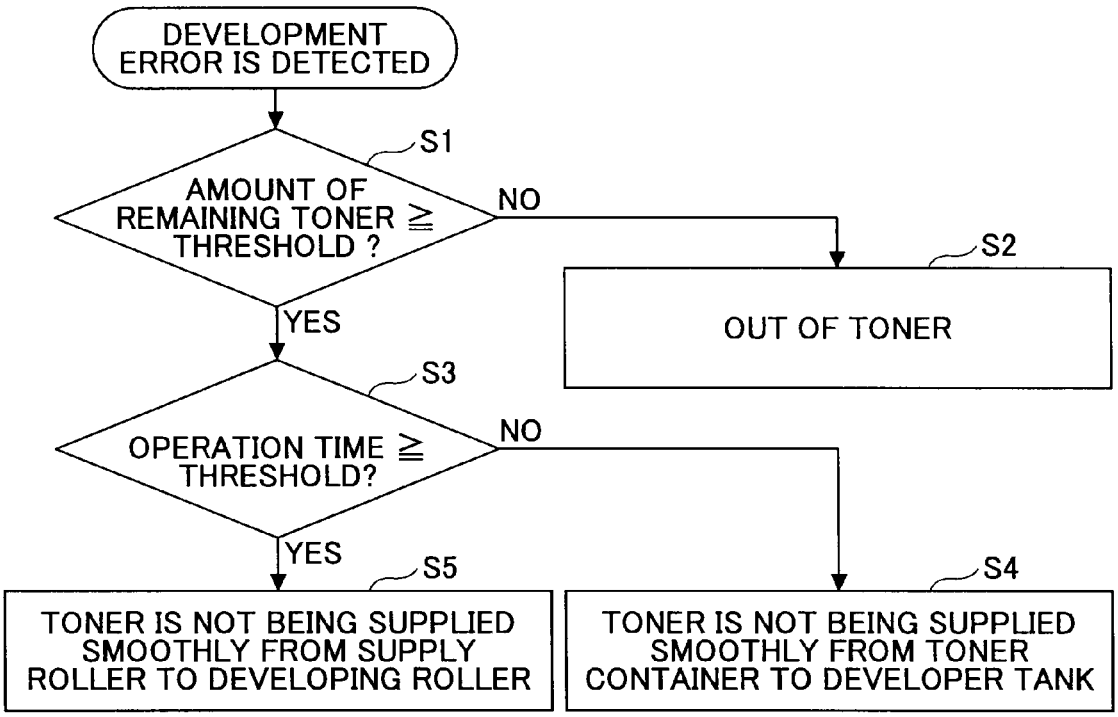
FIG. 6 is a flowchart showing a process performed by an error determining unit when a development error is detected.

FIG. 6 is a flowchart showing a process performed by the error determining unit 53 when a development error is detected.

When a development error is detected, the error determining unit 53 compares the amount of remaining toner detected by the remaining-toner-amount detecting unit 52 with a toner-amount threshold (S1). If the amount of remaining toner is smaller than the toner-amount threshold (NO in S1), the error determining unit 53 determines that the toner container 21 is out of toner (or empty) and sends an out-of-toner error message (S2). If the developing unit 4 is equipped with a toner supply mechanism, the error determining unit 53 may be configured to send a message requesting supply of toner. In the case of a process cartridge, which has no mechanism to supply toner from the outside, the error determining unit 53 may be configured to send a message requesting to replace the process cartridge.

If the amount of remaining toner is equal to or larger than the toner-amount threshold (YES in S1), the error determining unit 53 compares the operation time of the developing unit 4 measured by the operation time measuring unit 51 with an operation time threshold (S3). If the operation time is smaller than the operation time threshold (NO in S3), it is unlikely that degradation of toner (or a problem in toner transfer from the supply roller 24 to the developing roller 25) is the cause of the development error. Therefore, the error determining unit 53 determines that there is not enough toner in the developer tank 22 (that toner is not being supplied smoothly from the toner container 21 to the developer tank 22), and supplies toner from the toner container 21 to the developer tank 22 (S4). For example, if the developing unit 4 is incorporated in a process cartridge, the error determining unit 53 sends a message requesting the user to shake the process cartridge to move toner to the developer tank 22.

If the operation time is equal to or larger than the operation time threshold (YES in S3), the error determining unit 53 determines that toner is not being supplied smoothly from the supply roller 24 to the developing roller 25 because of degradation of the toner (S5). In this case, supplying toner to the toner container 21 is unlikely to solve the development error. Therefore, the error determining unit 53 sends a message requesting to replace the developing unit 4.

Third Embodiment

The current measuring unit 29 of the developing unit 4 of the first and second embodiments measures the electric current at timings as described below.

A controller (not shown) of the exemplary image forming apparatus monitors the sizes of images to be formed by users. If a solid-color image (or an image with a density larger than a predetermined threshold) larger than a predetermined size is detected, the controller causes the current measuring unit 29 to measure the electric current that flows at an instant when the detected image (hereafter called a current-detection image) is developed. A current-detection image is preferably longer than the circumference of the developing roller 25 in the sub-scanning direction. In other words, the length of a current-detection image in the sub-scanning direction is preferably longer than a length that can be developed by rotating the developing roller 25 once. While a non-image area (or a white portion of an image) is being processed, toner is not transferred to the photoconductive drum 2 and is kept on the developing roller 25. In this case, only a small amount of toner, if any, is transferred from the supply roller 24 to the developing roller 25, and it is difficult to correctly measure the electric current. Therefore, it is preferable to measure the electric current while an image having a sufficient size is being developed to correctly determine the amount of toner being supplied to the developing roller 25. In other words, while an image longer than the circumference of the developing roller 25 is being developed, it is possible to measure the electric current at an instant when toner is transferred onto an exposed surface of the developing roller 25. Also, a current-detection image used to measure the electric current preferably has a sufficient length in the main-scanning direction too, because the electric current generated by the transfer of toner becomes small if the area of an image being developed is small.

Using an image that covers the entire image forming area on the photoconductive drum 2 in the main-scanning direction is most preferable. With such an image, it is possible to detect the amount of transferred toner throughout the length of the developing roller 25. However, as long as an electric current that is within the detection range of the current measuring unit 29 is obtained, the length in the main-scanning direction of a current-detection image may be smaller than that of the image forming area. The measured electric current is divided by the area of the current-detection image to obtain an electric current per unit area, and a development error is determined based on the electric current per unit area. The above method makes it possible to determine a development error while an image requested by a user is being formed (or printed) and thereby eliminates the need to allocate time only to determine a development error.

The current measuring unit 29 may also be configured to measure the electric current during a toner refreshing operation. Many image forming apparatuses have a toner refresh mode to perform a toner refreshing operation where a dummy image (that is not to be formed on paper) is developed to consume (or purge) degraded toner and thereby to maintain image quality. Generally, a toner refreshing operation is performed when a developing unit is being used under a condition where toner is degraded quickly. Measuring the electric current while a toner refreshing operation is being performed, i.e., when toner is assumed to be degraded, makes it possible to save time and toner used to detect a development error and thereby makes it possible to efficiently perform a development error detecting process. Preferably, the dummy image used in a toner refreshing operation is longer in the sub-scanning direction than the circumference of the developing roller 25.

The charging characteristics and fluidity of toner are degraded over time because of mechanical stresses exerted on the toner in a developing unit. Mechanical stresses are exerted on toner, for example, when the toner is rubbed against a toner regulating blade or a supply roller and when the toner is carried or agitated in a developing unit. If the charging characteristics of toner are degraded because of the mechanical stresses, the toner remaining on a developing roller is charged to a reverse polarity. The toner with the reverse polarity does not adhere to a latent image, but instead adheres to a non-latent-image area on a photoconductor, resulting in scumming or reduced image density. In this embodiment, to prevent image quality degradation caused by degraded toner, a change in the amount of toner supplied from a supply roller to a developing roller is estimated based on an electric current that flows from the developing roller to the supply roller, and a development error is detected based on the estimated change in the amount of toner.

Among other image defects caused by degradation of toner, it is especially important to prevent density irregularity and voids in an image which are caused by the decrease in the amount of toner supplied to a developing roller. If toner is degraded, the toner is not smoothly transferred from a supply roller to a developing roller even when the amount of toner around the supply roller is sufficient. However, the amount of toner transferred from a supply roller to a developing roller is not detectable by an optical sensor or a mechanical detecting unit. An embodiment of the present invention makes it possible to detect the decrease in the amount of toner transferred from a supply roller to a developing roller based on an electric current that flows from the developing roller to the supply roller when electric charge of the toner is transferred from the supply roller to the developing roller. Thus, a development error can be detected by measuring the electric current and comparing the measured electric current or a change in the measured electric current with a threshold.

As described above, when printing is being performed normally, the electric current flowing from a developing roller to a supply roller changes gradually. If the electric current changes rapidly, it may indicate that a developer tank is out of toner or that the amount of toner being transferred from the supply roller to the developing roller is small. If printing is continued under such a condition, the quality of an image is reduced. An embodiment of the present invention makes it possible to detect a development error based on a rapid change in an electric current and thereby makes it possible to prevent degradation of image quality.

According to an embodiment of the present invention, the volume resistivity of a developing roller is set at $10^4$-$10^8$ Ωcm. This configuration makes it possible to accurately detect the change in the volume resistivity of toner and thereby makes it possible to improve the accuracy in detecting a development error. According to an embodiment of the present invention, the volume resistivity of a supply roller is set at $10^5$-$10^8$ Ωcm. This configuration makes it possible to accurately detect the change in the volume resistivity of toner between the supply roller and a developing roller and thereby makes it possible to improve the accuracy in detecting a development error.

An abnormal value of the electric current flowing from a developing roller to a supply roller may be detected when the amount of toner in a toner container (or a toner unit) is insufficient, when the amount of toner around the supply roller is insufficient, or when toner is not being transferred smoothly from the supply roller to the developing roller due to degradation of the toner. According to an embodiment of the present invention, when an abnormal electric current value is detected, an error determining unit compares the amount of remaining toner with a predetermined threshold, determines a cause of the abnormal electric current value (or a development error) based on the comparison result, and sends a message corresponding to the determined cause.

Degradation of toner in a developing unit progresses due to mechanical stresses as the operation time of the developing unit increases. Therefore, if the operation time is small, it is unlikely that the degradation of toner (or a problem in toner transfer from the supply roller to the developing roller) is the cause of the abnormal value of the electric current or a development error. On the other hand, if the operation time is large, it is likely that the charging characteristics and fluidity of toner are degraded and the toner is not being transferred smoothly from the supply roller to the developing roller. According to an embodiment of the present invention, if the operation time is small when an abnormal electric current value is detected, an error determining unit determines that the amount of toner around the supply roller is insufficient and supplies toner to a developer tank or sends a message requesting the user to supply toner to a developer tank. Alternatively, the error determining unit may be configured to determine that a toner container is out of toner (or empty) and to send a message requesting supply of toner. Meanwhile, if the operation time is large when an abnormal electric current value is detected, the error determining unit determines that toner is not being supplied smoothly from the supply roller to the developing roller because of degradation of the toner and sends a message requesting replacement of the developing unit. The error determining unit may also be configured to determine the cause of a development error based on the amount of remaining toner and the operation time of the developing unit and to send a message corresponding to the cause of the development error. Further, the error determining unit may be configured to determine the degradation level of the developing unit and the necessity of toner supply based on the amount of remaining toner and the operation time, and to send a message according to the determined degradation level and necessity of toner supply.

An embodiment of the present invention provides an image forming apparatus including a developing unit as described above. In the image forming apparatus, an error determining unit of the developing unit detects a development error based on an electric current that flows from a developing roller to a supply roller while the developing roller develops an image that is longer in the sub-scanning direction than the circumference of the developing roller and longer in the main-scanning direction than a predetermined threshold. Preferably, a development error detecting process is performed during a normal printing process without interfering with the printing process. Also, to obtain an electric current sufficient to detect a development error, electric current measurement is preferably performed only when an image having an area that is large enough to cause a sufficient amount of electric current is being formed. With this configuration, the electric current is measured while the developing roller rotates one or more times. This makes it possible to measure the electric current that flows when toner is transferred onto an exposed surface of the developing roller (the surface is exposed when the toner on it is used to develop an image).

Many image forming apparatuses have a toner refresh mode to perform a toner refreshing operation where a dummy image (that is not to be formed on paper) is developed to consume (or purge) degraded toner and thereby to maintain image quality. Generally, a toner refreshing operation is performed when a developing unit is being used under a condition where toner is degraded quickly. According to an embodiment of the present invention, the electric current is measured while a toner refreshing operation is being performed, i.e., when toner is assumed to be degraded. In other words, electric current measurement is not performed when a development error is unlikely to occur. This configuration makes it possible to save time and toner used to detect a development error and thereby makes it possible to efficiently perform a development error determining process. Preferably, the dummy image used in a toner refreshing operation is longer in the sub-scanning direction than the circumference of the developing roller.

Embodiments of the present invention make it possible to detect a development error based on the amount of toner transferred from a supply roller to a developing roller and thereby make it possible to take measures to prevent degradation of image quality.

Also, embodiments of the present invention make it possible to determine whether an appropriate amount of toner is being supplied to a developing roller without relying on the amount of remaining toner in a developer tank.

The present invention is not limited to the specifically disclosed embodiments, and variations and modifications may be made without departing from the scope of the present invention.

The present application is based on Japanese Priority Application No. 2007-116549, filed on Apr. 26, 2007, the entire contents of which are hereby incorporated herein by reference.

What is claimed is:

1. A developing device, comprising:

a developing roller;

a supply roller that is in contact with the developing roller and configured to supply toner to the developing roller;

a current measuring unit configured to measure an electric current that flows from the developing roller to the supply roller when toner is supplied from the supply roller to the developing roller;

a controller to monitor a size of an image to be developed by the developing device, the controller controlling the current measuring unit to measure the electric current that flows from the developing roller to the supply roller based on the image size; and an error determining unit configured to detect a development error of the developing roller based on the electric current measured by the current measuring unit.

2. The developing device as claimed in claim 1, wherein the error determining unit is configured to determine that the development error has occurred if the electric current measured by the current measuring unit becomes smaller than a predetermined threshold.

3. The developing device as claimed in claim 1, wherein the error determining unit is configured to determine that the development error has occurred if a change in the electric current measured by the current measuring unit exceeds a predetermined threshold.

4. The developing device as claimed in claim 1, wherein the error determining unit is configured to determine that the development error has occurred if a rate of change in the electric current measured by the current measuring unit exceeds a predetermined threshold.

5. The developing device as claimed in claim 1, wherein a volume resistivity of the developing roller is between $10^4$ and $10^8$ Ωcm.

6. The developing device as claimed in claim 1, wherein a volume resistivity of the supply roller is between $10^5$ and qj$10^8$ Ωcm.

7. The developing device as claimed in claim 1, further comprising:

a remaining-toner-amount detecting unit configured to detect an amount of remaining toner;

wherein after detecting the development error, the error determining unit is configured to compare an amount of remaining toner detected by the remaining-toner-amount detecting unit with a predetermined threshold and to send a message corresponding to a result of a comparison.

8. The developing device as claimed in claim 1, further comprising:

an operation time measuring unit configured to measure operation time of the developing device;

wherein after detecting the development error, the error determining unit is configured to compare the operation time measured by the operation time measuring unit with a predetermined threshold and to send a message corresponding to a result of a comparison.

9. The developing device as claimed in claim 1, further comprising:

a remaining-toner-amount detecting unit configured to detect an amount of remaining toner; and an operation time measuring unit configured to measure operation time of the developing device;

wherein after detecting the development error, the error determining unit is configured to determine a cause of the development error based on the detected amount of remaining toner and the measured operation time and to send a message corresponding to a cause of the development error.

10. An image forming apparatus, comprising:

a developing device that includes a developing roller;

a supply roller that is in contact with the developing roller and configured to supply toner to the developing roller;

a current measuring unit configured to measure an electric current that flows from the developing roller to the supply roller when toner is supplied from the supply roller to the developing roller;

a controller to monitor a size of an image to be developed by the developing device, the controller controlling the current measuring unit to measure the electric current that flows from the developing roller to the supply roller based on the image size; and an error determining unit configured to detect a development error of the developing roller based on the electric current measured by the current measuring unit.

11. The image forming apparatus as claimed in claim 10, wherein the error determining unit is configured to detect the development error based on the electric current that flows from the developing roller to the supply roller while the developing roller develops an image that is longer in a sub-scanning direction than a circumference of the developing roller and longer in a main-scanning direction than a predetermined threshold.

12. The image forming apparatus as claimed in claim 10, wherein the image forming apparatus has a toner refresh mode to perform a toner refreshing operation where a dummy image is developed to purge degraded toner; and the error determining unit is configured to detect the development error based on the electric current while the toner refreshing operation is being performed.

13. A method of detecting a development error in a developing device having a developing roller, the method comprising the steps of:

supplying, at a supply roller in contact with the developing roller, toner to the developing roller;

measuring, at a current measuring unit, an electric current that flows from the developing roller to the supply roller when toner is supplied from the supply roller to the developing roller;

monitoring, at a controller, a size of an image to be developed by the developing device;

controlling, at the controller, the current measuring unit to measure the electric current that flows from the developing roller to the supply roller based on the image size; and detecting, at an error determining unit, a development error of the developing roller based on the measured electric current.

14. The method as claimed in claim 13, wherein occurrence of the development error is determined if the electric current flowing from the developing roller to the supply roller becomes smaller than a predetermined threshold.

15. The method as claimed in claim 13, wherein occurrence of the development error is determined if a change in the electric current flowing from the developing roller to the supply roller exceeds a predetermined threshold.

16. The method as claimed in claim 13, wherein occurrence of the development error is determined if a rate of change in the electric current flowing from the developing roller to the supply roller exceeds a predetermined threshold.

17. The method as claimed in claim 13, further comprising the steps of:

detecting an amount of remaining toner;

comparing the detected amount of remaining toner with a predetermined threshold when the development error is detected based on the measured electric current; and sending a message corresponding to a result of the comparison.

18. The method as claimed in claim 13, further comprising the steps of:

measuring operation time of the developing device;

comparing the measured operation time with a predetermined threshold when the development error is detected based on the measured electric current; and sending a message corresponding to a result of the comparison.

* * * * *